US010814578B2

(12) United States Patent
Schalk et al.

(10) Patent No.: US 10,814,578 B2
(45) Date of Patent: Oct. 27, 2020

(54) PERFORATION TOOL FOR A DEVICE FOR THE PRODUCTION BY MACHINE OF A FILLING MATERIAL PRODUCT AND A DEVICE FOR THE PRODUCTION BY MACHINE OF A FILLING MATERIAL PRODUCT

(71) Applicant: Sprick GmbH, Bielefeld (DE)

(72) Inventors: Bastian Schalk, Lage (DE); Christoph Engemann, Lemgo (DE)

(73) Assignee: Sprick GmbH Bielefelder Papier-und Wellpappenwerke & Co., Bielefeld (DE)

( * ) Notice: Subject to any disclaimer, the term of this patent is extended or adjusted under 35 U.S.C. 154(b) by 553 days.

(21) Appl. No.: 15/024,325

(22) PCT Filed: Sep. 18, 2014

(86) PCT No.: PCT/EP2014/002535
§ 371 (c)(1),
(2) Date: Mar. 23, 2016

(87) PCT Pub. No.: WO2015/039756
PCT Pub. Date: Mar. 26, 2015

(65) Prior Publication Data

US 2016/0207274 A1 Jul. 21, 2016

(30) Foreign Application Priority Data

Sep. 23, 2013 (DE) ..... 10 2013 015 875

(51) Int. Cl.
*B31D 5/00* (2017.01)
*B26D 7/18* (2006.01)
(Continued)

(52) U.S. Cl.
CPC ..... *B31D 5/0047* (2013.01); *B26D 1/405* (2013.01); *B26D 1/626* (2013.01); *B26D 7/1818* (2013.01);
(Continued)

(58) Field of Classification Search
CPC ..... B26D 1/405; B26D 1/626; B26D 7/1818; B26F 1/08; B26F 1/20; B26F 1/10;
(Continued)

(56) References Cited

U.S. PATENT DOCUMENTS 2,774,427 A * 12/1956 Crabtree ..... B26F 1/08 83/109
3,064,513 A * 11/1962 Hershey ..... B26F 1/08 83/164
(Continued)

FOREIGN PATENT DOCUMENTS

DE 20 2004 016106 U1 1/2005
DE 10 2012 018 867 A1 3/2014
JP 2000296513 A * 10/2000 ..... B26D 7/025

OTHER PUBLICATIONS

International Preliminary Report on Patentability from corresponding International Application No. PCT/EP2014/002535, 12pp., dated Apr. 7, 2016.
(Continued)

*Primary Examiner* — Dariush Seif
(74) *Attorney, Agent, or Firm* — Brinks Gilson & Lione

(57) ABSTRACT

Perforation tool for a device for the manufacturing by machine of a dunnage material which is to be formed of a single layer or multi-layer paper web whereby the perforation tool is configured for introducing a perforation into the dunnage material and comprises: at least one perforation nose, at least one perforation reception wherein the at least one perforation nose and the at least one perforation recep-
(Continued)

tion are associated with each other such that, for perforating, the at least one perforation nose can retract and extend with respect to the at least one perforation reception, and at least one stripper which is associated with the at least one perforation nose and/or the at least one perforation reception such that, when disengaging, perforated dunnage material is removed from the at least one perforation nose and/or from the at least one perforation reception.

18 Claims, 13 Drawing Sheets

(51) Int. Cl.

| | |
|---|---|
| ***B26F 1/20*** | (2006.01) |
| ***B26D 1/62*** | (2006.01) |
| ***B26D 1/40*** | (2006.01) |
| ***B26F 1/08*** | (2006.01) |
| *B26D 7/08* | (2006.01) |

(52) U.S. Cl.
CPC ..... *B26F 1/08* (2013.01); *B26F 1/20* (2013.01); *B31D 5/006* (2013.01); *B31D 5/0043* (2013.01); *B26D 7/08* (2013.01); *B31D 2205/0047* (2013.01); *B31D 2205/0052* (2013.01); *B31D 2205/0058* (2013.01)

(58) Field of Classification Search
CPC .. B31D 5/0039; B31D 5/0047; B31D 5/0043; B31D 2205/0047; B31D 5/006; B31D 2205/0052; B31D 2205/0058
USPC ..... 493/352, 967; 101/24, 26
See application file for complete search history.

(56) References Cited

U.S. PATENT DOCUMENTS 3,277,756 A * 10/1966 Des Jardins ..... B26D 7/1818 83/116
3,509,797 A * 5/1970 Johnson ..... B31D 5/0047 493/340
3,552,244 A * 1/1971 Smith, Jr. ..... B26D 7/1818 493/60
3,650,877 A * 3/1972 Johnson ..... B31D 5/0047 156/183
3,843,113 A * 10/1974 Schaffer ..... B65H 45/30 281/38
4,467,687 A * 8/1984 Fokos ..... B26D 1/626 33/633
4,594,926 A * 6/1986 Propheter ..... B26F 1/04 83/345
4,717,613 A * 1/1988 Ottaviano ..... B31D 5/0047 156/493
4,750,896 A * 6/1988 Komaransky ..... B31D 5/0047 493/357
4,862,778 A * 9/1989 Dixon ..... B26D 1/626 101/226
4,951,967 A * 8/1990 Michalik ..... B26F 1/14 281/2
4,962,683 A * 10/1990 Scheffer ..... B26D 1/626 83/103
4,968,291 A * 11/1990 Baldacci ..... B31D 5/0047 493/354
5,029,506 A * 7/1991 Glendening ..... B26D 7/08 83/660
5,186,444 A * 2/1993 Palmatier ..... B26D 7/1818 270/21.1
5,188,581 A * 2/1993 Baldacci ..... B31D 5/0047 493/381
5,365,819 A * 11/1994 Maida ..... B21D 31/04 493/363
5,524,930 A * 6/1996 Foster ..... B26F 1/18 281/21.1
5,755,656 A * 5/1998 Beierlorzer ..... B31D 5/0047 493/464
5,807,229 A * 9/1998 Febel ..... B26D 7/27 493/464
5,910,079 A * 6/1999 Watanabe ..... B31D 5/006 493/352
6,017,299 A * 1/2000 Ratzel ..... B31D 5/0047 493/464
6,035,613 A * 3/2000 Lencoski ..... B31D 5/0047 53/472
6,106,452 A * 8/2000 Baumuller ..... B31D 5/0047 493/464
6,168,560 B1 * 1/2001 Pluymaekers ..... B31D 5/0047 493/340
6,176,818 B1 * 1/2001 Simmons, Jr. ..... B31D 5/0047 493/346
6,207,249 B1 * 3/2001 Lencoski ..... B31D 5/0047 138/166
6,277,459 B1 * 8/2001 Lencoski ..... B31D 5/0047 206/521
6,280,373 B1 * 8/2001 Lanvin ..... B26D 7/025 493/194
6,387,029 B1 * 5/2002 Lencoski ..... B31D 5/0047 493/464
6,416,451 B1 * 7/2002 Ratzel ..... B31D 5/0047 232/43.1
6,910,997 B1 * 6/2005 Yampolsky ..... B26F 1/22 493/350
7,044,040 B1 * 5/2006 Smith ..... B26D 7/1818 493/342
7,163,503 B2 * 1/2007 Toth ..... B31D 5/0047 493/365
7,182,010 B2 * 2/2007 Blank ..... B23D 35/008 83/338
7,361,132 B2 * 4/2008 Ratzel ..... B31D 5/0047 493/340
7,651,455 B2 * 1/2010 Yampolsky ..... B26F 1/22 493/407
8,708,882 B2 * 4/2014 Chan ..... B31D 5/0047 493/407
2002/0166425 A1 * 11/2002 Takeuchi ..... B26F 1/02 83/13
2003/0087741 A1 * 5/2003 Toth ..... B31D 5/0047 493/464
2003/0139272 A1 * 7/2003 Simmons, Jr. ..... B31D 5/0047 493/394
2005/0034582 A1 * 2/2005 De Marco ..... B26D 5/34 83/469
2009/0082187 A1 * 3/2009 Cheich ..... B31D 5/0047 493/350
2011/0179958 A1 * 7/2011 Johnson ..... B26D 7/1818 101/26
2014/0155241 A1 * 6/2014 Cheich ..... B31D 5/0043 493/405

OTHER PUBLICATIONS

International Search Report from corresponding International Application No. PCT/EP2014/002535, 8pp., dated Sep. 18, 2014.
Office Action from corresponding German Application No. 10 2013 015 875.3, 5pp., dated Jun. 5, 2014.

* cited by examiner

PERFORATION TOOL FOR A DEVICE FOR THE PRODUCTION BY MACHINE OF A FILLING MATERIAL PRODUCT AND A DEVICE FOR THE PRODUCTION BY MACHINE OF A FILLING MATERIAL PRODUCT

CROSS REFERENCE TO RELATED APPLICATION

This application represents the National Stage entry of PCT International Application No. PCT/EP2014/002535 filed on Sep. 18, 2014, which claims the benefit of German Patent Application No. 10 2013 015 875.3 filed on Sep. 23, 2013, both of which are fully incorporated herein by reference.

BACKGROUND

The disclosure relates to a perforation tool for a device for the production by machine of a dunnage material, such as a dunnage material manufacturing machine. The mobile manufacturing machine serves to be placed at the location of the object to be packaged as necessary to produce a preassembled dunnage material for the use as a packaging or wrapping material based on a paper web roll. The dunnage material to be produced is three-dimensional and has the characteristics of a damping cushion or a pad.

A single layer or multi-layer paper web serves as a basis material for the manufacturing of the dunnage material which is reshaped in a pre-shaping station of the manufacturing machine into a three-dimensional dunnage material. The pre-defined preform of the dunnage material comprises at least one pad cavity extending in the longitudinal direction.

An example for such a dunnage material is known from DE 10 2005 053 319 A1 where a paper web roll is subtracted from a funnel-shaped reception from its inner side whereby a spiral tube is formed. In order to create, amongst others, two cavities extending in a longitudinal direction (subtracting direction of the paper web roll) a reshaping device is provided following the funnel reception which is formed by a pair of opposed embossing wheels. The embossing teeth of the embossing wheels work substantially at a middle area of the spiral tube and emboss a sequence of embossing valleys and hills wherein the hill-valley-arrangement results in two separated cavities. To cut off the preformed dunnage material to a desired length a stationary knife is provided.

A similar packaging material manufacturing machine is known from EP 0 414 849 B1 which inwardly rolls a longitudinal edge of the paper web in a first forming step. In a central middle area of the paper web which connects the two inwardly rolled longitudinal edges an embossing is introduced to stiffen the packaging material product in the direction of travel, which is formed by a sequence of valley and elevation portions. In the embossed deformation middle area additional perforations are introduced, which shall extend through all of the layers of the multi-layer paper web to maintain the pad form of the dunnage material. In the known packaging material product machine according to EP 0 414 849 B1 in the area of pre-shaping station, namely the embossing wheels, often particularly at higher conveying speeds a paper jam occurs which interrupts the manufacturing flow.

It is an object of the disclosure to overcome the disadvantages of the state of the art, particularly to provide a packaging material product machine which outputs a formstable dunnage material wherein the risk of the formation of a paper jam in the area of the pre-shaping station is reduced.

SUMMARY

Accordingly, a perforation tool for a device for the production by machine of a dunnage material formed from a single layer of multi-layer paper web is provided. The perforation tool according to the disclosure serves to introduce one or more perforations, in particular press cuts, into the dunnage material to increase the form stability of the pad of the formed, three-dimensional dunnage material. The perforations function as paper stitchings and form cutting edges in the dunnage material which gets adhered to adjacent cutting edges of different layers wherein the interlocking works against restoring forces of the reshaped web materials. The perforation tool according to the disclosure comprises at least one perforation nose and at least one perforation reception wherein the at least one perforation nose and the at least one perforation reception are kinematically, particularly rotationally, associated with each other such that, for perforating according to a defined relative movement, the at least one perforation nose can retract and extend with respect to the at least one perforation reception. Hereto, the at least one perforation nose and the at least one perforation reception can be movably, particularly rotationally, mounted with respect to each other stationary at the manufacturing device. When retracting and extending, the reshaped paper web lies between the perforation parts, which is perforated by a respective punching or cutting edge of the perforation nose and/or of the perforation reception. The perforation reception, in particular its limiting walls with punching edges, serves as a counter-bearing for the reshaped paper web at which the paper web is held when perforating to perform the perforation cut. According to the disclosure, the perforation tool comprises an additional stripper which releases the perforated dunnage material from the at least one perforation nose at least when the at least one perforation nose extends. The stripper is a component being structurally separated from a cutting device, such as a cutter of the manufacturing device, cutting off the dunnage materials which can perform a relative movement thereto and can work together with the perforation nose and/or reception and/or particularly the cutting device to respectively wipe away paper web material. The stripper can be synchronized with respect to the movement of the perforation nose and/or the perforation reception such that in the moment when the perforation nose disengages the perforation reception (or vice versa) the stripper is actuated synchronously to possibly wipe away paper web material which remained at the perforation nose and/or perforation reception.

The risk of a paper jam within the manufacturing device may be reduced in particular when an adhering of the perforated dunnage materials at the perforation nose is prevented. Even when the perforated paper web material adheres only for a short time to the perforation nose and/or the perforation reception, the paper web material is deflected from the defined conveying path whereby the risk of a paper jam is significantly increased. Whether the paper web material adheres to the perforation nose and/or the perforation reception depends also on the condition of the paper which builds the paper web. The stripper, which can be movably arranged with respect to the at least one perforation nose, actively supports that the dunnage material, which for example adheres to the at least one perforation nose due to the conformity of the dunnage product, is pushed away.

The stripper can be formed as a separate component, additionally to the perforation reception and/or to the perforation nose, which possibly can provide a separate wiping function while an independent spring-slide-construction is formed which is biased when the perforation nose engages the perforation reception, and when disengaging the spring biased slide pushes the potentially adhered dunnage material from the perforation nose and/or the perforation reception. The biasing of the spring-slide-construction is performed by the perforation nose and/or by the limiting walls of the perforation reception by directly engaging the slide which is thereby biased. When disengaging, the perforation reception and the perforation nose move whereby the slide is directly relocated through releasing the preload force, whereby the wiping function is fulfilled simultaneously.

In one embodiment, the stripper is formed by an elastic mass, which is for example formed as an elastomeric body, such as a PU-foam. The at least one perforation nose and/or the at least one perforation reception is at least partially embedded into the elastic mass. Under the influence of the retracting forces which act between the perforation nose and/or the perforation reception the embedding mass is elastically replaced whereby the perforation nose and/or the perforation reception are exposed and an optimum perforation effect is achieved. The elasticity of the elastic embedding mass automatically causes the wiping and releases the perforation nose and/or the perforation reception of potentially adhering paper web material.

In one embodiment, the stripper comprises a passive state according to which a punching edge or cutting edge of the at least one perforation nose and/or of the at least one perforation reception is at least partially occupied by the stripper, particularly by the elastic embedding mass. The perforation nose particularly comprises a plurality of, particularly exactly two, parallel extending punching edges. Also the at least one perforation reception can comprise at least two parallel diametrically opposed punching edges which are realized by limiting walls of the perforation reception. The embedding of the perforation nose and/or the perforation reception in an elastic mass has the advantage that the perforation nose and/or the perforation reception are protected in the passive state, when the punching edge is at least partially occupied, and an undesired dragging away of the paper web material is prevented.

Furthermore, the stripper comprises an active state into which the stripper is brought when the at least one perforation nose engages the at least one perforation reception. In the active state particularly the at least partially occupied punching edge of the at least one perforation nose and/or the at least one perforation reception is exposed from the elastic mass due to its elastic compression. When the at least one perforation nose disengages the at least one perforation reception, the stripper gets into the passive state from its biased active state self-actingly, particularly due to its elasticity. In the event of the transition from the active state into the passive state, the stripper pushes the paper web material which is potentially adhered to the perforation nose and/or the perforation reception away from the respective one. For example, a compressed elastic mass can respectively relax whereby the wiping function is realized.

In a further development, the at least one perforation nose and the at least one perforation reception are rotatably mounted with respect to each other, particularly with a stationary axis of rotation, such that the at least one perforation nose can turn into and off the at least one perforation reception, e.g., gearwheel-like. Hereto, the at least one perforation nose and the at least one perforation reception can each be arranged at a shaft which can be rotatably mounted at the manufacturing device.

The perforation nose shaft, or also the perforation reception shaft, can carry a stripper. The blade of the cutter is substantially straight, for example, and is particularly arranged transverse, e.g., substantially perpendicular to the direction of travel of the paper web in order to completely cut off the pre-shaped paper web in a single cutting stroke in a direction transverse the direction of travel to build the preassembled dunnage material. The substantially cylindrical orbit of the blade of the cutter is crossed by the therethrough forwarded paper web material approximately tangential such that a continuous interruption-free forwarding and cutting of the reshaped paper web can be achieved. The perforation nose shaft and/or the perforation reception shaft is substantially mounted transverse, particularly perpendicular to the direction of travel of the paper web such that the cutter cuts the paper web along the whole width at its whole length according to an approximately tangential crossing of the direction of travel of the paper web. In a cutting engagement of the blade with the reshaped paper web, the circumferential speed is substantially equal to the linear speed of travel of the paper web within the manufacturing device. In one embodiment, the circumferential speed of the blade is slightly higher. The same is valid for the perforation nose or the perforation reception adjacent the stripper.

In one embodiment, at least one perforation nose and/or at least one perforation reception is arranged in a rotational direction of the shaft in a leading and/or trailing manner with respect to the blade such that a perforation is introduced into the dunnage material both in a leading manner in the direction of travel and in a trailing manner in the direction of travel with respect to the separating protection.

In one embodiment, the cutter, including its blade, is completely embedded into the elastic mass. Moreover, the blade can be associated with a stamp pad arranged at the perforation reception shaft such that when cutting off the dunnage material, the stamp pad displaces the elastic mass at the cutter and/or at the perforation nose due to its elastic compression to expose the blade and/or the perforation nose. When the blade extends, the stamping pad releases the compressed elastic mass such that the elastic mass can push away self-actingly the paper web material, potentially adhered to the blade and/or the perforation nose, due to its elastic re-shaping characteristic.

In one embodiment, the elastic mass is softer than the stamping pad which is softer than the stiff blade of the cutter and/or the perforation nose and/or the perforation reception.

The realization of the stripper by means of an elastic mass in which the at least one perforation nose and/or the perforation reception and/or the knife of the cutter are embedded has, among others, also the advantage that both the knife and the perforation nose and the perforation reception are stabilized by the embedding into the elastic mass. Limiting walls of the perforation reception, the stamp pad, and also the perforation nose can displace the elastic mass adjacent the at least one perforation nose, the blade and the perforation reception in order to release the cutting edges. Due to the gearwheel-like engagement, the elastic displacing of the elastic mass is only realized in case of a cutting. Otherwise the blade and/or the cutting edge is initially partially occupied by the elastic mass.

In a further development, the cutter includes two clamper plates which are attached to the perforation nose shaft to limit a reception slot. The reception slot can be orientated in such a way that the axis of rotation of the perforation nose shaft lies in the plane of the slot. The clamper plates can be axially pushed onto the perforation shaft and may be detachable to ensure an exchanging of the perforation nose part of the tool from the perforation nose shaft.

In the slot, a cutter may be removable attached. The cutting knife can be exchanged in case of wear by removing the removable securing means, such as screws. The cutting knife is arranged in the reception slot such that its blade significantly radially protrudes the clamper plates. In one embodiment, more than a quarter of the radial height of the cutting knife protrudes the clamper plates. At an axially protruding end edge of the clamper plates, which is undercut-formingly reinforced, each side comprises a row of perforation noses which substantially extend about the same radial height as the blade. In one embodiment, the radial height of the perforation noses is smaller than the respective one of the cutting knife. In order to provide a spacious reception for the stripper, particularly the elastic mass, two lateral gripper pads are attached to the clamper plates wherein the two lateral gripper pads comprise two radially extending limiting arms which limit the reception space for the stripper. In the reception space the stripper is fixedly, but movably received for providing the wiping function. In order to supply a pushing back of the stripper and therefore an elastic biasing to the stripper, the reception space is open in a radial direction to allow an access, particularly a deformation access, of the at least one perforation reception upon the stripper. It is clear that, regarding the cutting knife, an access of the stamp pad is relevant. The radially extending limiting arms of the gripper pads prevent a spreading particularly of the elastic mass in a circumferential direction, in particular when the stripper elastically deforms.

In order to ensure a force-fit arrangement of the perforation noses at least one perforation nose is coupled in contact with both the clamper plate and the clamping jaw by means of a hook-shaped engagement.

In a further development, a carrier for the stamp pad is arranged at the perforation nose shaft. The carrier comprises at least two holding plates which are radially extending from the perforation reception shaft and are, in contrary to the clamper plates for the cutting knife, arranged at a greater distance to each other. The parallel extending holding plates limit a seat for the stamp pad and for an elastic stripper which is associated with the at least one perforation reception. The holding plates each comprise an axially end edge which can taper. At the end edge, a recess can be formed for forming the respective perforation reception which is form-fitted for a punching engagement with the perforation nose.

For the realization of the stripper, associated with the at least one perforation reception, a recess, in which an elastic bar is inserted, is introduced into the stamp pad adjacent the cutting pad each adjacent the end edge portions of the holding plates. The elastic bar is dimensioned such that the at least one perforation nose can engage and elastically be pushed back when engaging. When the perforation nose disengages, the elastic bar relaxes whereby the wiping function is realized.

When using an elastic mass for the stripper at the perforation nose, delimiting walls of the recess of the perforation reception adjacent the perforation nose push back the elastic mass in a radial direction to expose the perforation nose for the punching process.

Furthermore, the disclosure relates to a device for the production by machine of a three-dimensional dunnage material which is to be formed of a single layer or multilayer paper web. The manufacturing device comprises a pre-shaping station which reshapes the paper web into a three-dimensional filling product with at least one hollow crumple space extending in the direction of the web. In one embodiment, the dunnage material comprises two cushion-like hollow crumple spaces extending in the direction of the web which are connected over an embossed middle area. The central embossing prevents the paper web reshaped into a hollow crumple space from unfolding. Further, the manufacturing device comprises a cutter following the pre-shaping station in the direction of travel of the paper web which cuts off paper web portions of desired length of the dunnage material from the preformed paper web. According to the disclosure, the manufacturing device also comprises the perforation tool according to the disclosure.

The perforation tool can be realized as a component union with the cutter or as a separate component.

The manufacturing device is a mobile machine which, starting from a roll of paper, provides a preassembled dunnage material at a location where it is to be used as a packaging material. The mobility of the manufacturing device has the advantage that the storage volume for the paper web roll is significantly smaller than manufacturing a pre-manufactured dunnage material in front and delivering it to the packaging location afterwards.

With the perforation tool according to the disclosure and with the manufacturing device according to the disclosure, a trouble-free manufacturing operation at the packaging location can be realized.

Further features and advantages of certain embodiments are clarified by the following description of one embodiment by means of the enclosed drawings, in which show:

DETAILED DESCRIPTION

Figure 1:
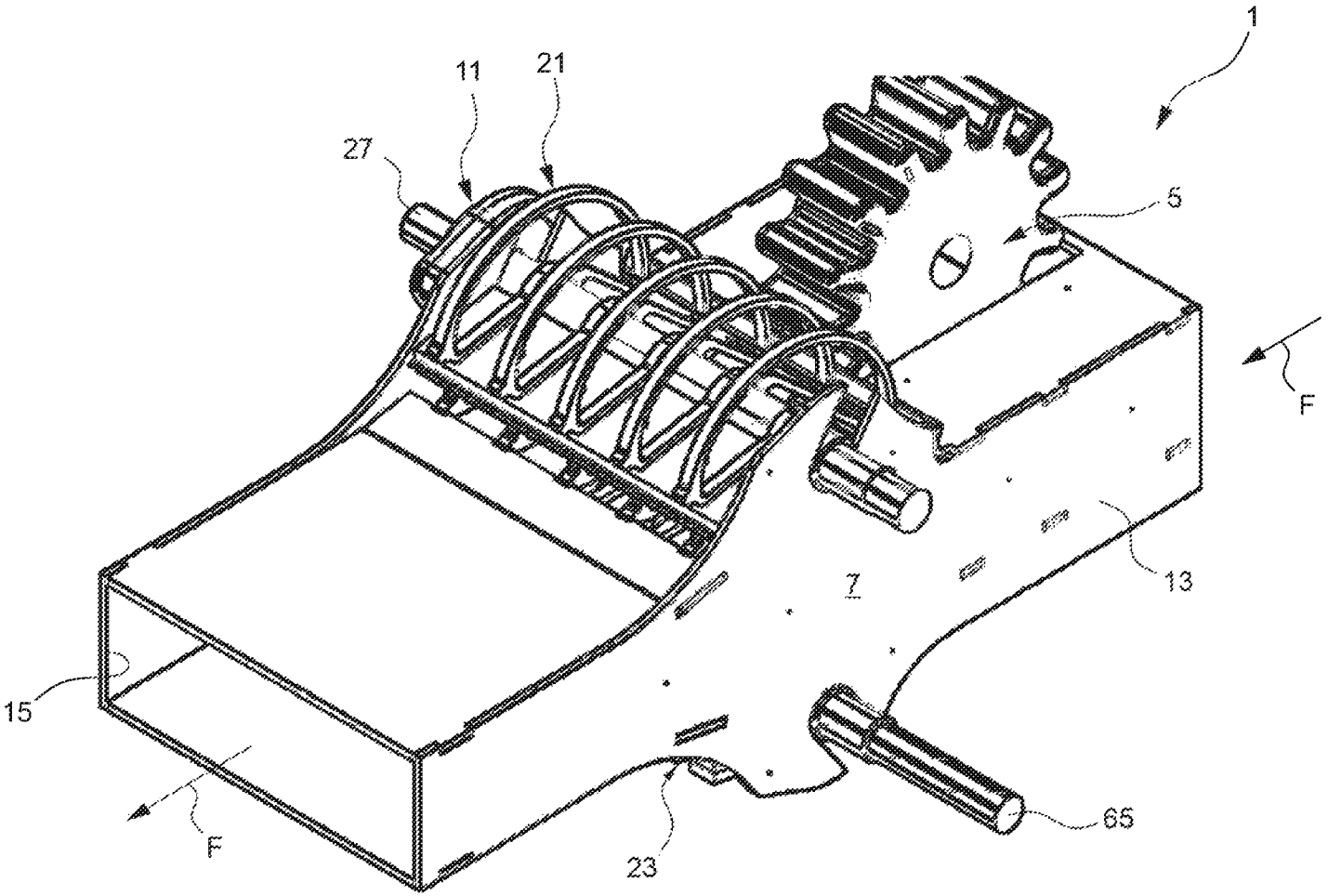
FIG. 1 a perspective view of a part of the manufacturing device according to one embodiment.

In FIG. 1 the manufacturing device according to one embodiment in general has the reference sign 1 wherein pre-shaping station of the manufacturing device 1 is realized by an embossing wheel pair 5 wherein a transfer station is not shown, arranged in a leading manner with respect to the direction of travel F, at which longitudinal strips of the paper web being unwound from the paper web roll (not shown) can be transferred or wound up across a middle area extending in a longitudinal direction of the paper web. In this way, the paper web layers to be forwarded which are lying above each other double within the manufacturing device 1. In this embodiment, the longitudinal strips of the paper web are lying free in its middle area. The pre-shaping station implemented as an embossing wheel pair 5 deforms the paper web in the middle area, where the longitudinal edges lie, whereby they are hold in the middle area of the paper web and cushion cavities laterally extending in a direction of travel F are formed.

An example for such a pre-shaping station is known from DE 10 2012 018 941 A1 which content shall be included into the description of the figures.

Following the embossing wheel pair 5 in the direction of travel F, an additional tool station 7 is provided which contains the perforation tool 11 according to one embodiment. The paper web is forwarded through a shaft-like housing part 13 of the manufacturing device 1 which contains recesses for bearings. The housing part 13 defines an access and disposal opening 15.

The perforation tool 11 according to one embodiment consists of two main parts, namely a nose tool 21 and a receiving tool 23, which is nearly completely hidden by the housing part 13 in FIG. 1. The nose tool 21 and the receiving tool 23 engage which each other gearwheel-like in order to realize the perforation in the continuously forwarded paper web material and to create the desired dunnage material.

Figure 2:
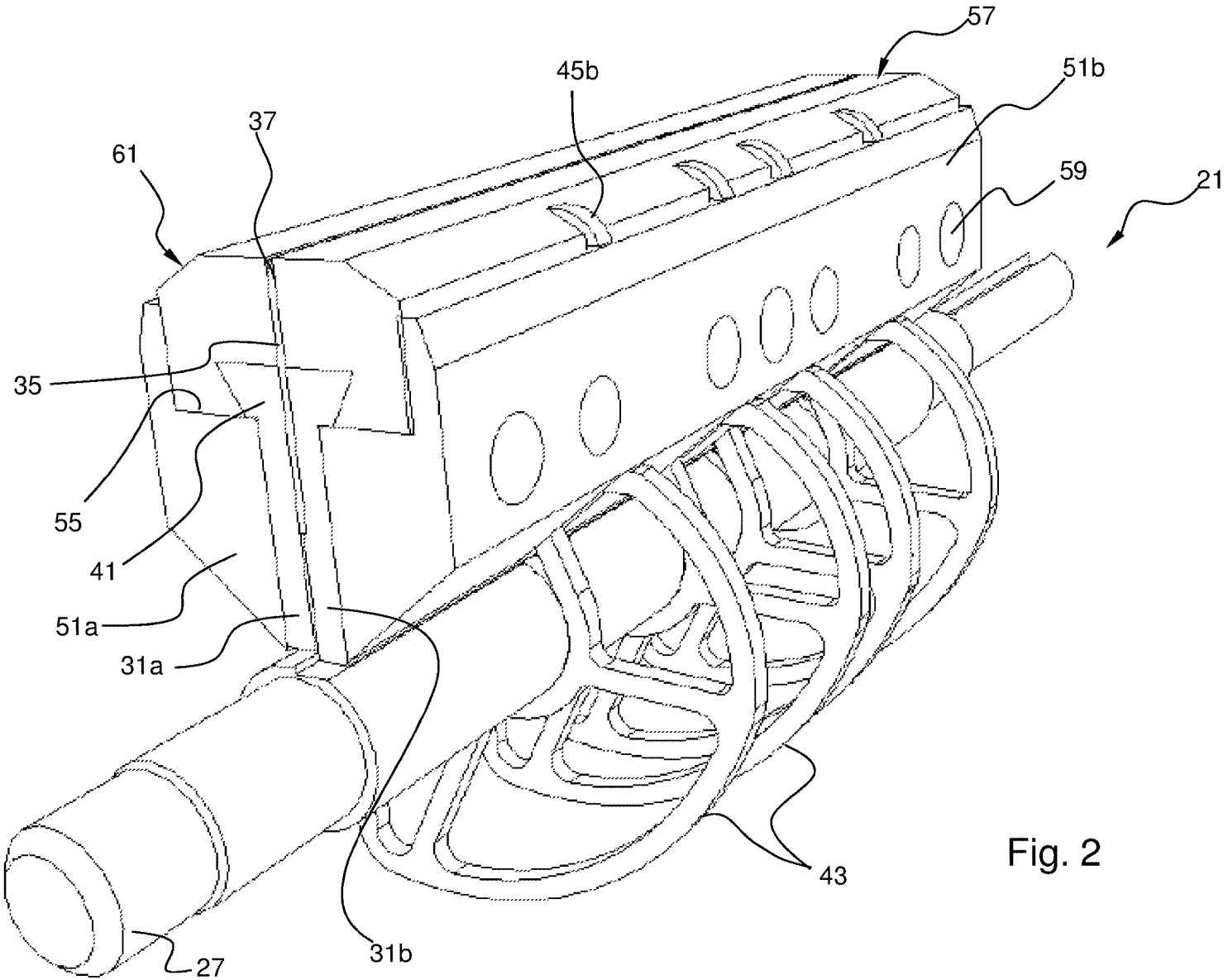
FIG. 2 a perspective view of one of the two main parts of a perforation tool according to one embodiment, namely the nose tool part of the manufacturing device.
Figure 3:
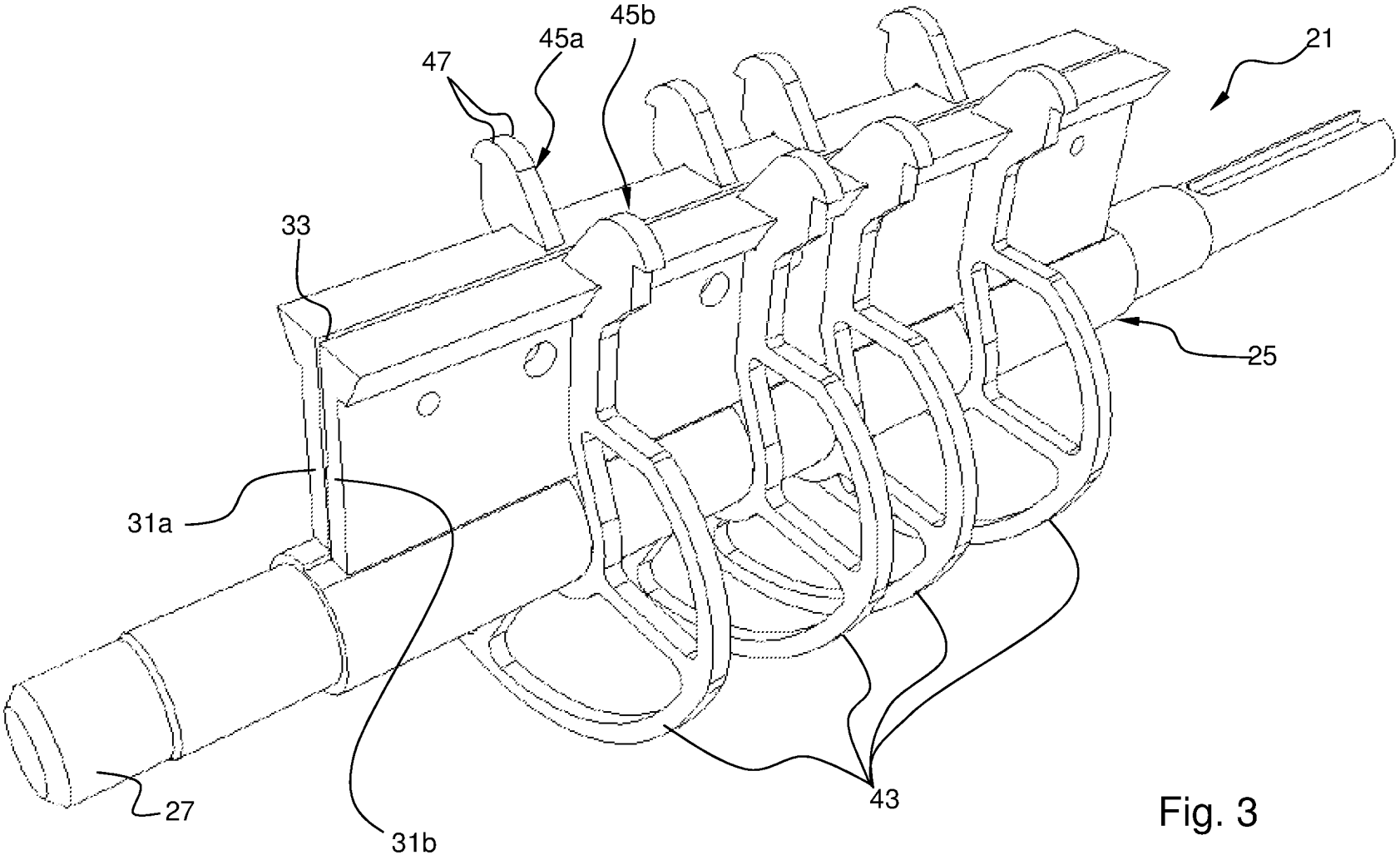
FIG. 3 a perspective view of a basic structure of the nose tool part according to FIG. 2.

The nose tool 21 is shown in detail in FIGS. 2 and 3 wherein FIG. 3 merely shows its stiff basic structure 25. The stiff basic structure 25 of the nose tool 21 comprises a nose shaft 27 at which two clamper plates 31*a*, 31*b* are axially pushed and attached. The clamper plates 31*a*, 31*b* limit a reception slot 33, turned to itself, of one or a few millimeters, in which a cutting knife 35 with a blade 37 is fixedly and fittingly arranged. It is shown in FIG. 2 that an essential part of the cutting knife 35 radially protrudes a reinforced axially, straight extending end edge portion 41 of the clamper plates 31*a*, 31*b*.

The clamper plates 31*a*, 31*b* are held by four hub ring frames 43 which lead integrally into a pair of perforation noses 45*a*, 45*b* at its end edges wherein a perforation nose 45*a* engages the clamper plate 31*a* hook-like while the other perforation nose 35*b* engages the clamper plate 31*b*.

As shown in FIGS. 2 and 3 the end edge portion 41 of the clamper plates 31*a*, 31*b* is reinforced and respectively forms an undercut whereby the hook engagement of the perforation noses 45*a*, 45*b* is adjusted thereto. Each perforation nose 45*a*, 45*b* comprises two punching wheels 47 which are partially exposed at the radial end of the perforation nose 45*a*, 45*b*.

Additionally the nose tool 21 includes two gripper pads 51*a*, 51*b* each comprising radially extending limiting arms which limit a cavity 55 into which the end edge portion 41 of the clamper plates 31*a*, 31*b*, the cutting knife 35 as well as the perforation noses 45*a*, 45*b* extend. A stripper 57 is form-fittingly introduced, particularly molded, into the cavity 55 for the perforation noses 45*a*, 45*b* in the form of a two-part PU-foam body 61 wherein the one part of the PU-foam body is separated from the other part by means of a reception slot extension which is a radial extension of the reception slot 33 of the clamper plates 31*a*, 31*b*. The elastic PU-foam body 61 of the stripper 57, formed as an elastic mass, surrounds approximately completely the cutter knife 35 (at least the part which radially protrudes from the clamper plates 31*a*, 31*b*) and partially the perforation noses 45*a*, 45*b*. The perforation noses 45*a*, 45*b* as well as the cutter knife 35 are contactingly surrounded in such a way by the elastic mass of the PU-foam body that they are partially embedded.

The gripper pads 51*a*, 51*b* comprise through holes 59 which allow a screwing of the gripper pads 51*a*, 51*b*. Additionally the gripper pads 51*a*, 51*b* comprise clearing slits facing the perforation nose shaft 27 in which the respective hub ring frames 43 which carry the perforation noses 45*a*, 45*b* protrude and which extend to the axial end edge portion 41 of the clamper plates 31*a*, 31*b*.

The hub ring frames 43 and the respectively associated perforation noses 45*a*, 45*b* are manufactured from one piece, wherein the shaft-hub-connection can be realized by shrinking.

A locally limited deformation of the areas of the PU-foam body 61 adjacent the respective perforation nose 45*a*, 45*b* or of the blade 37 causes an exposure of the perforation nose, in particular of its punching wheels 47, respectively the blade 37, whereby the cutting function of the perforation nose 45*a*, 45*b* and the cutting function of the blade 37 is completely activated.

Figure 4A:
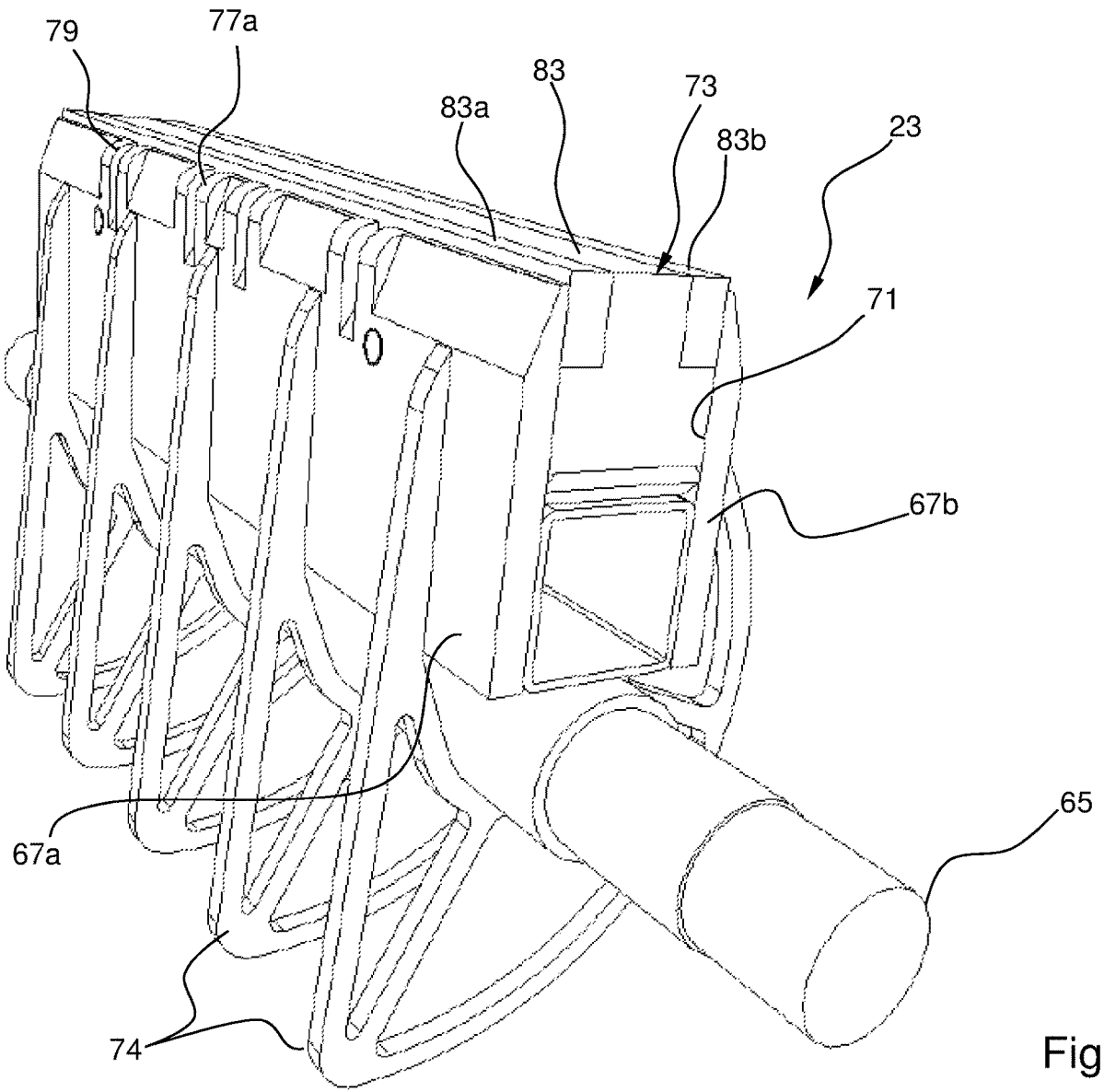
FIG. 4*a* a perspective view of a first embodiment of the other part of the perforation tool, namely the receiving tool part.
Figure 5A:
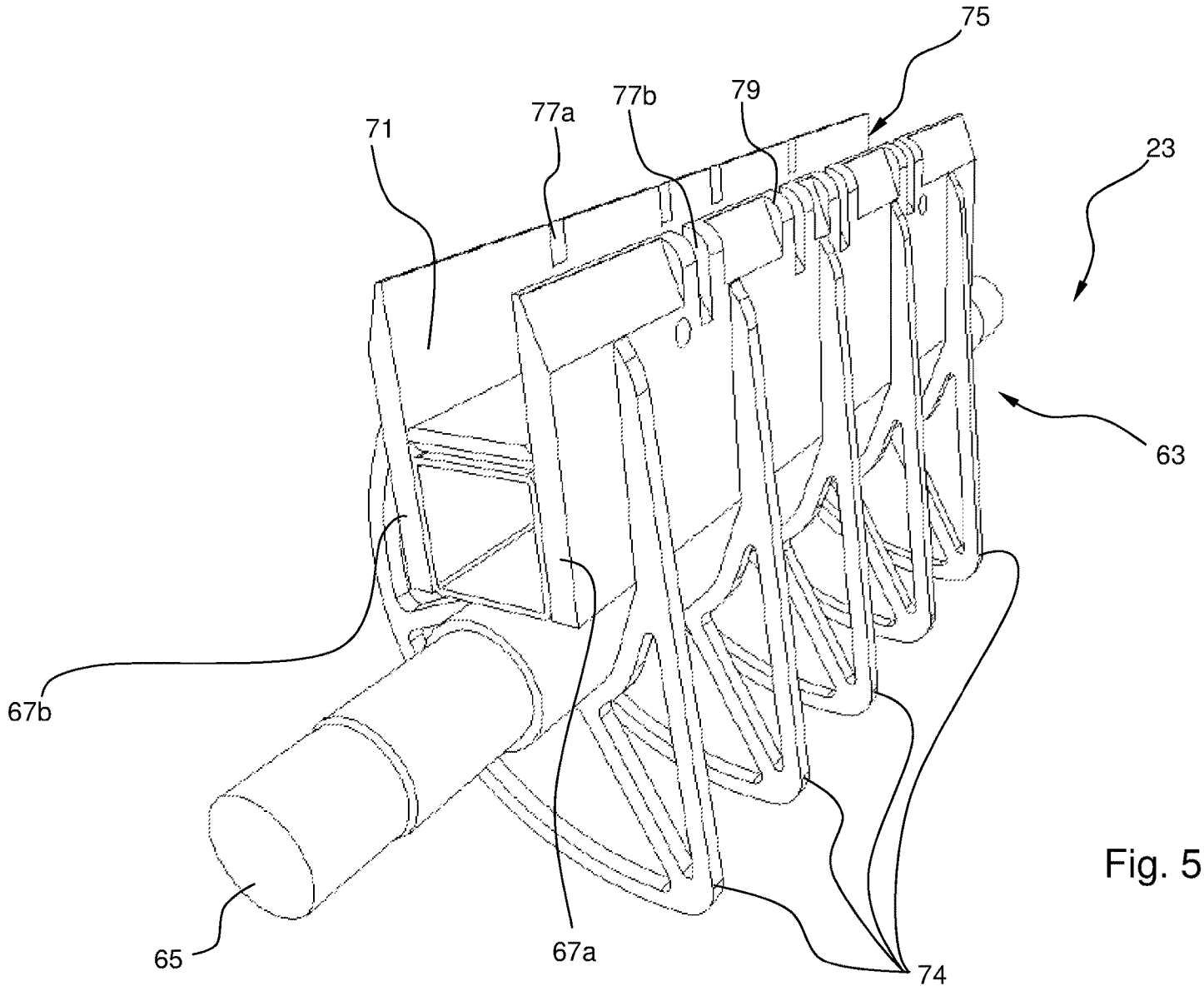
FIG. 5*a* a perspective view of a first embodiment of a basic structure of the receiving tool part according to FIG. 4*a;*

The reception tool 23 is responsible for the local elastic deformation of the PU-foam body 61 which is illustrated with regard to a first exemplary embodiment by means of FIGS. 4*a* and 5*a*. As the nose tool 21, the reception tool 23 of the perforation tool 11 comprises a basic structure 63 which also comprises a shaft, namely the perforation reception shaft 65. Two holding plates 67*a*, 67*b* extend from the perforation reception shaft 65, which parallel radially extend from the perforation reception shaft 65. The distance between the inner sides of the holding plates 67*a*, 67*b* is substantially equal to the diameter of the perforation reception shaft 65 wherein the holding plates 67*a*, 67*b* facing each other include a seat 71 for a stamp pad 73.

In order to attach the holding plate 67*a*, 67*b* to the perforation reception shaft 65 a plurality of, particularly five, hub ring frames 74 are provided which are substantially equal to the components 43 of the nose tool 21 wherein no perforation noses are provided. It is to be noted that the perforation reception shaft 65 can carry the perforation noses 45*a*, 45*b* as well as that the perforation nose shaft 27 can form the perforation receptions, which embodiment is not shown in the drawings.

Figure 6A:
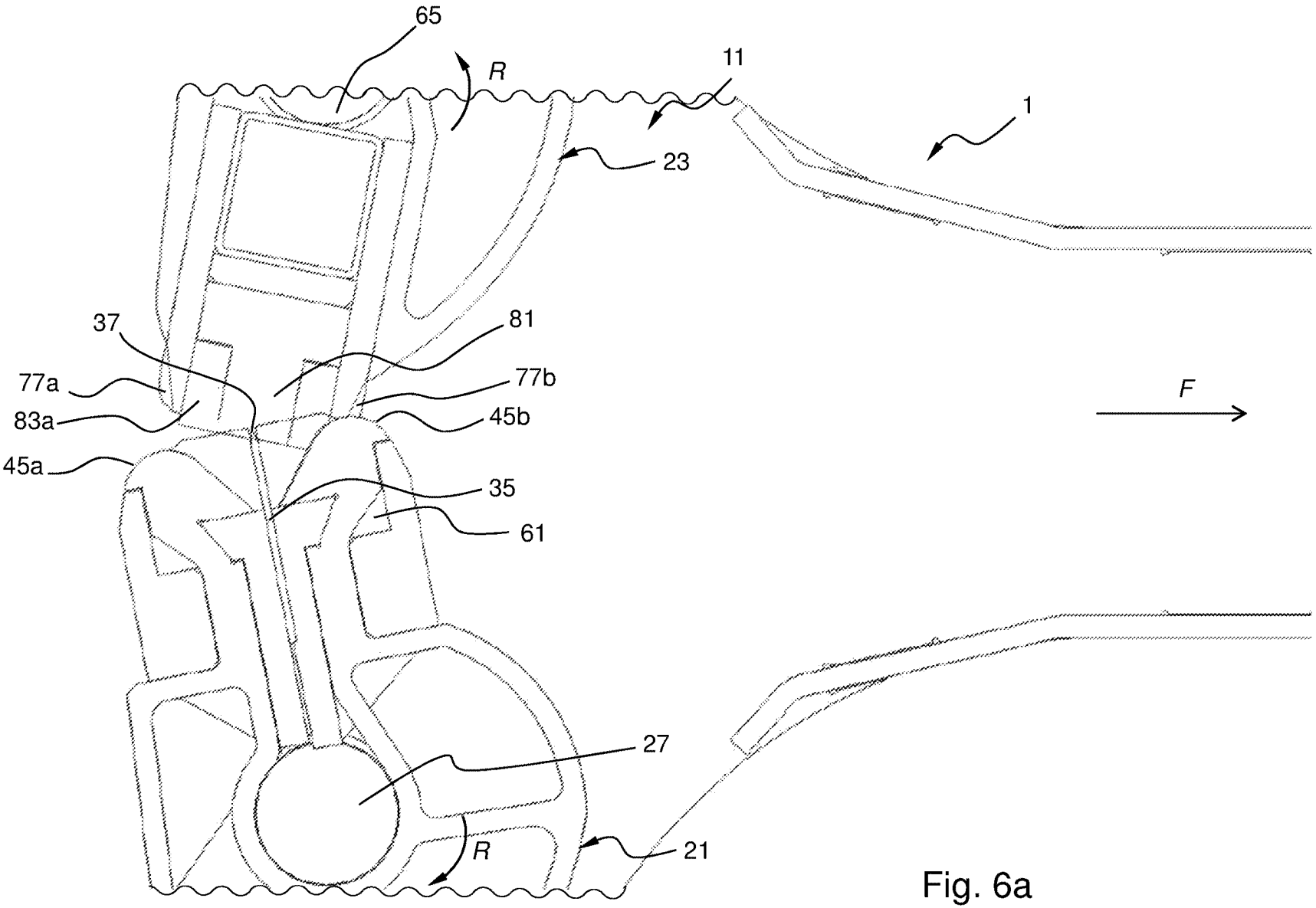
FIGS. 6*a*-6*c* cross-sectional views of the perforation tool according to one embodiment with the receiving tool part according to FIG. 4*a* in three different operational states during and after the perforation process.
Figure 6B:
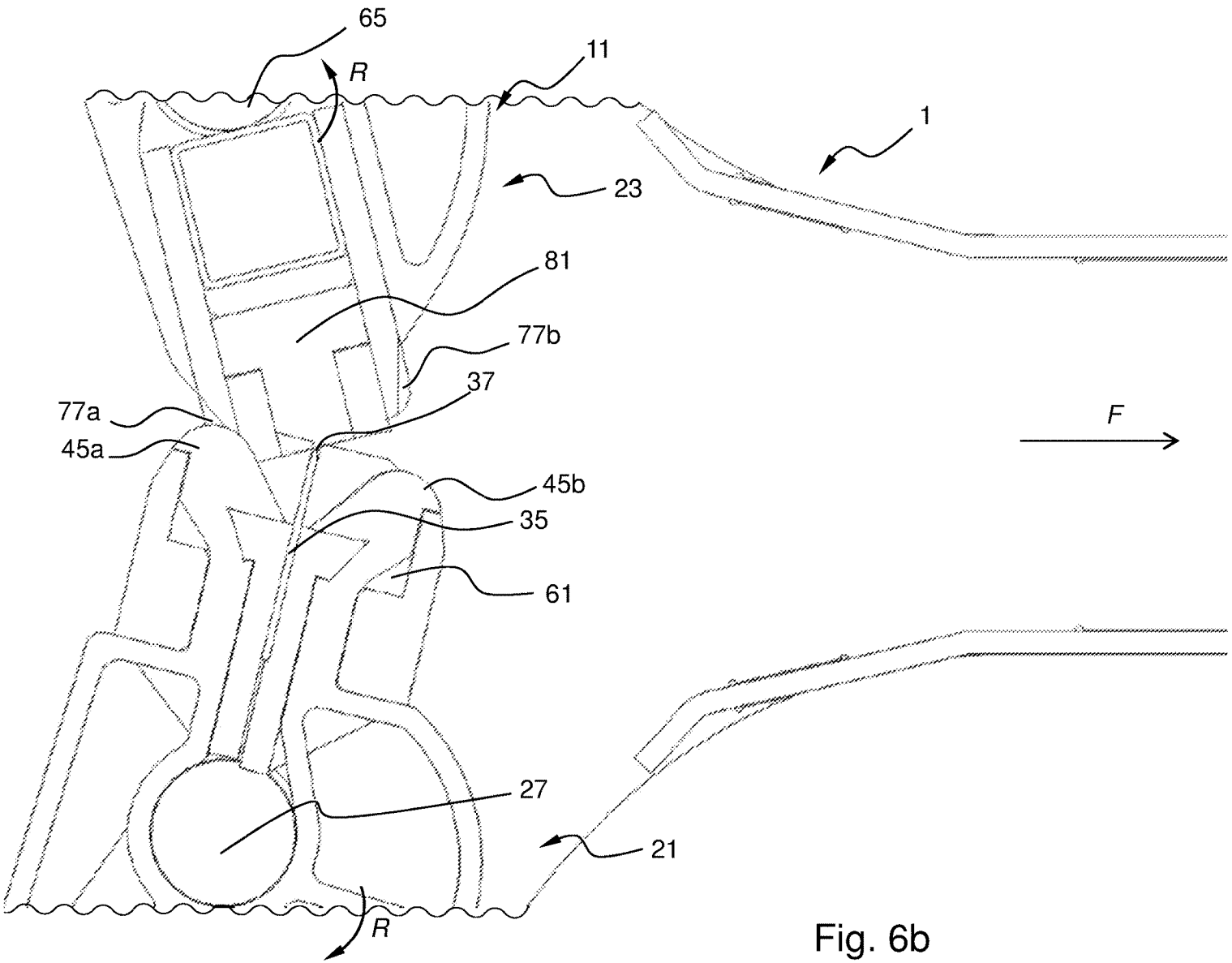
Figure 6C:
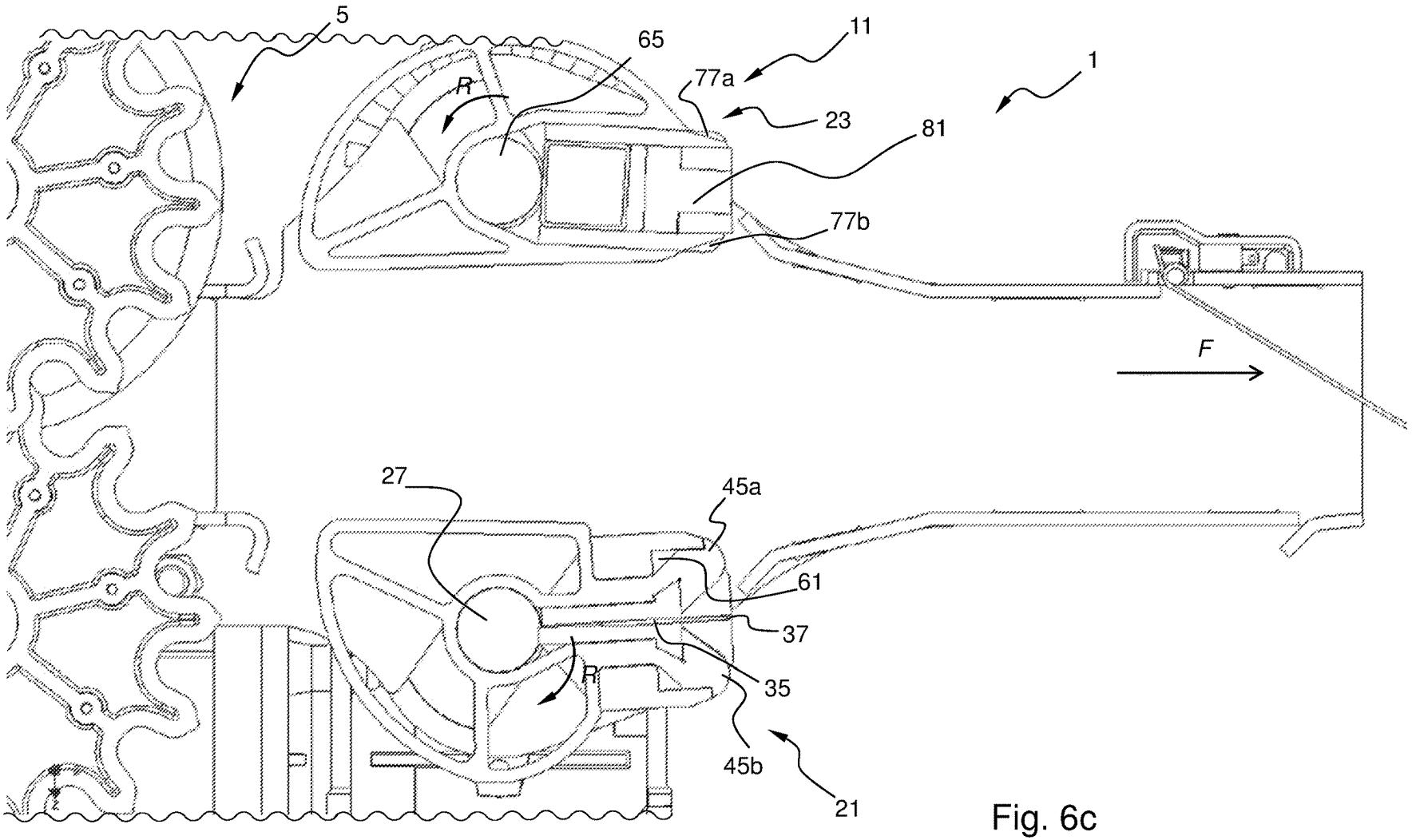

The function of the reception of the perforation noses is realized at the reception tool 23 at the axial end edge portion 75 of the holding plates 67*a*, 67*b* in which a number of slit recesses 77*a*, 77*b*, which is equal to the number of perforation noses 45*a*, 45*b*, is introduced. The slit recesses 77*a*, 77*b* form the perforation receptions in the shown embodiment according to the figures. The slit recesses 77*a*, 77*b* are dimensioned in a way that, according to a loose fit, the perforation noses 45*a*, 45*b* can contactlessly retract and extend in a circumferential rotational direction, if the tool parts 21, 23 are in a contactless perforation engagement, when turning in and off according to a gearwheel as shown in FIGS. 6*a* to 6*c*. In the area of the slit recesses 77*a*, 77*b*, the axial end edge portion 75 is locally reinforced such that at the free end of the reinforced area, two pairs of curved punching edges 79 which also interact perforatingly with the respective punching edge of the perforation nose 45*a*, 45*b*.

The stamp pad 73 comprises a cutting pad 83 which is centrically arranged and laterally framed by two more elastic deformation bars 83*a*, 83*b*. The elastic deformation bars 83*a*, 83*b* form the stripper for the perforation reception 77*a*, 77*b*. The perforation noses 45*a*, 45*b* deform the elastic deformation bars when retracting and displace them sectionwise radially inwardly (adjacent the slit recesses). When extending, the deformation bars 83*a*, 83*b* return back to its original unloaded form and potentially thereby displace adhered paper web material. The elastic deformation bars are also formed from PU-foam as the PU-foam body 61 of the stripper 57 for the perforation noses 45*a*, 45*b*.

Figure 4B:
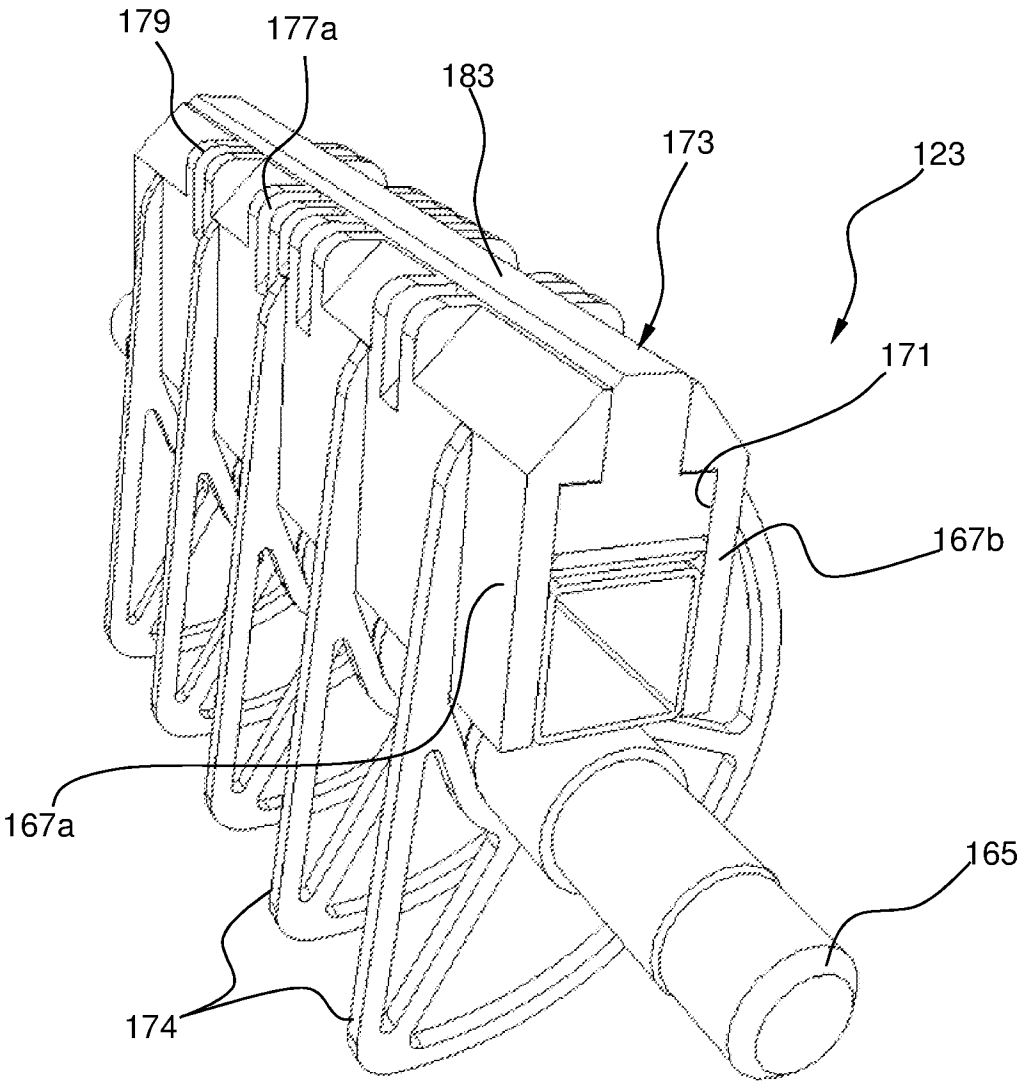
FIG. 4*b* a perspective view of a second embodiment of the other part of the perforation tool, namely the receiving tool part.
Figure 5B:
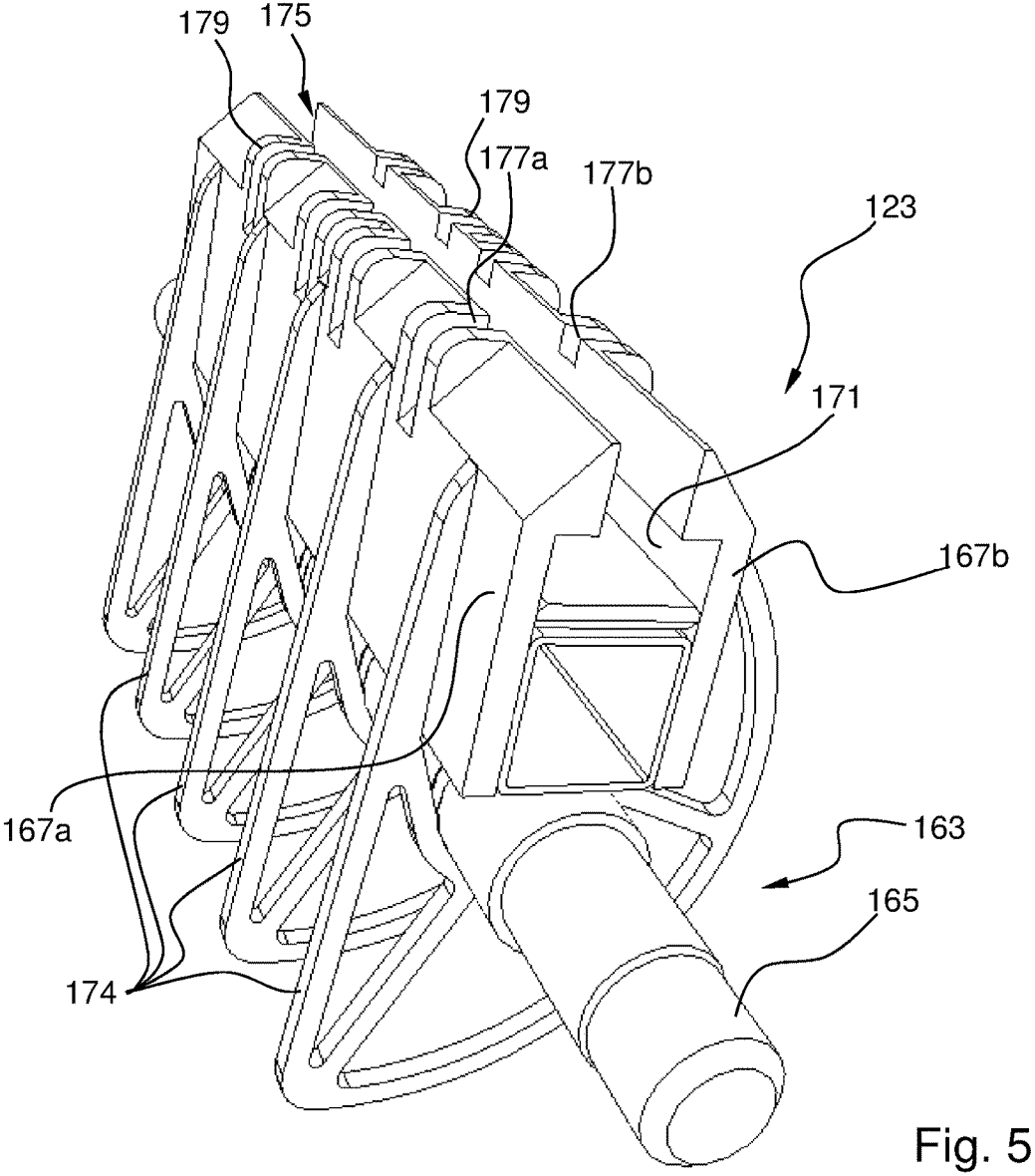
FIG. 5*b* a perspective view of a second embodiment of a basic structure of the receiving tool part according to FIG. 4*b;*

FIGS. 4*b* and 5*b* show a receiving tool in a second embodiment where identical or similar components have identical reference signs as in the embodiment of FIGS. 4*a* and 5*a*, which are increased by 100.

The receiving tool 123 differs from the embodiment according to FIGS. 4*a* and 5*a* in that no deformation bars 83*a*, 83*b* are provided and the radial ends of the holding plates 167*a*, 167*b* run towards the radial front side of the cutting pad 183. The holding plates 167*a*, 167*b* form at its radial stamping front side wedge-shaped strips which form a T-shaped undercut in the seat 171. This variant is, due to the low number of components, assembly-friendly and allows anchoring the cutting pad 183 secure and fix into the receiving tool 123. Apart from the before-mentioned differences, the receiving tool 123 functions like the first embodiment according to FIGS. 4*a* and 4*b* with the difference that the perforation noses 145*a*, 145*b* do not protrude through the slit recesses into the deformation bars but extend into the slit recesses 177*a*, 177*b* which extend to the cutting pad 163.

In FIGS. 6*a* to 6*c*, the perforation tool 11 in the manufacturing device 1 is provided to create preassembled dunnage materials wherein the two shafts 27, 65 are mounted at the housing part 11 of the manufacturing device 1.

As can be seen in FIGS. 6*a* to 6*c*, both tool parts 21, 23 are arranged with respect to each other that, in case of a rotational passage ("6 o'clock respectively 12 o'clock position"), the radially extending plates, the clamper plates 31*a*, 31*b* as well as the holding plates 67*a*, 67*b*, are parallel to each other. The cutting knife 35 comprises the same orientation, wherein both axis of rotation of the shafts 65, 27 lie in the plane of the cutting knife 35.

In FIGS. 6*a* and 6*b*, when the nose tool 21 and the receiving tool 23 are in a gearwheel-like passing engagement, it is indicated how the PU-foam body 61 as well as the deformation bars 83*a*, 83*b* are radially inwardly elastically compressed, due to the engagement of the reinforced end edge portion 75 adjacent the slit recesses 77*a*, 77*b* as well as adjacent the perforation noses 45*a*, 45*b* whereby the respective wiping function of both the PU-foam body 61 and the deformation bars 83*a*, 83*b* is activated. In this way, the respective perforation noses 45*a*, 45*b* and the blade 37 as well as the slit recesses 77*a*, 77*b* are completely exposed for the cutting function. In FIG. 6*a*, the perforation nose 45*b* and the respective slit recess 77*b* as well as the blade 37 are activatingly exposed such that they perforate/cut the paper web material as desired, which is not shown in greater detail. The cut, leading dunnage material comprises a row of perforations arranged in a transverse direction, which prevent the preassembled dunnage materials from unfolding, adjacent the cutting edge which extends perpendicular to the direction of travel F.

When the tools 21, 23 rotate further in a rotational direction R, the leading perforation nose 45*b* disengages the respective slit recess 77*b* whereby at the same time, due to the elasticity of the PU-foam, the wiping function of both the PU-foam body 67 and the deformation bars 83 is performed to potentially push adhered paper web material from the respective punching edges 45, 79 as well as from the blade 37 whereby a deflection of the preassembled dunnage material from the conveying path is prevented and therefore, the risk of a paper jam is reduced.

Afterwards, the trailing perforation nose 45*a* engages the respective slit recess 77*a* (see FIG. 6*b*). In this way, also the leading cutting edge of the dunnage material, close to the cutting edge already introduced, is provided with a row of transversely consecutively arranged perforations. The reinforced wall at the slit recess 77*a* displaces the PU-foam body 61 adjacent the perforation nose 45*a* whereby it is exposed, and vice versa, with respect to the deformation bar 83*b*. At this stage the blade 37 has already disengaged the cutting pad 83 such that at least the cutting process is completed.

As can be seen in FIGS. 6*a* to 6*c*, the packaging material product is cut at the transversely extending straight blade 37 with one stroke, because the cylindrical circumferential rotational casing of the blade 37 tangentially cuts the conveying path of the pre-shaped paper web.

Figure 7A:
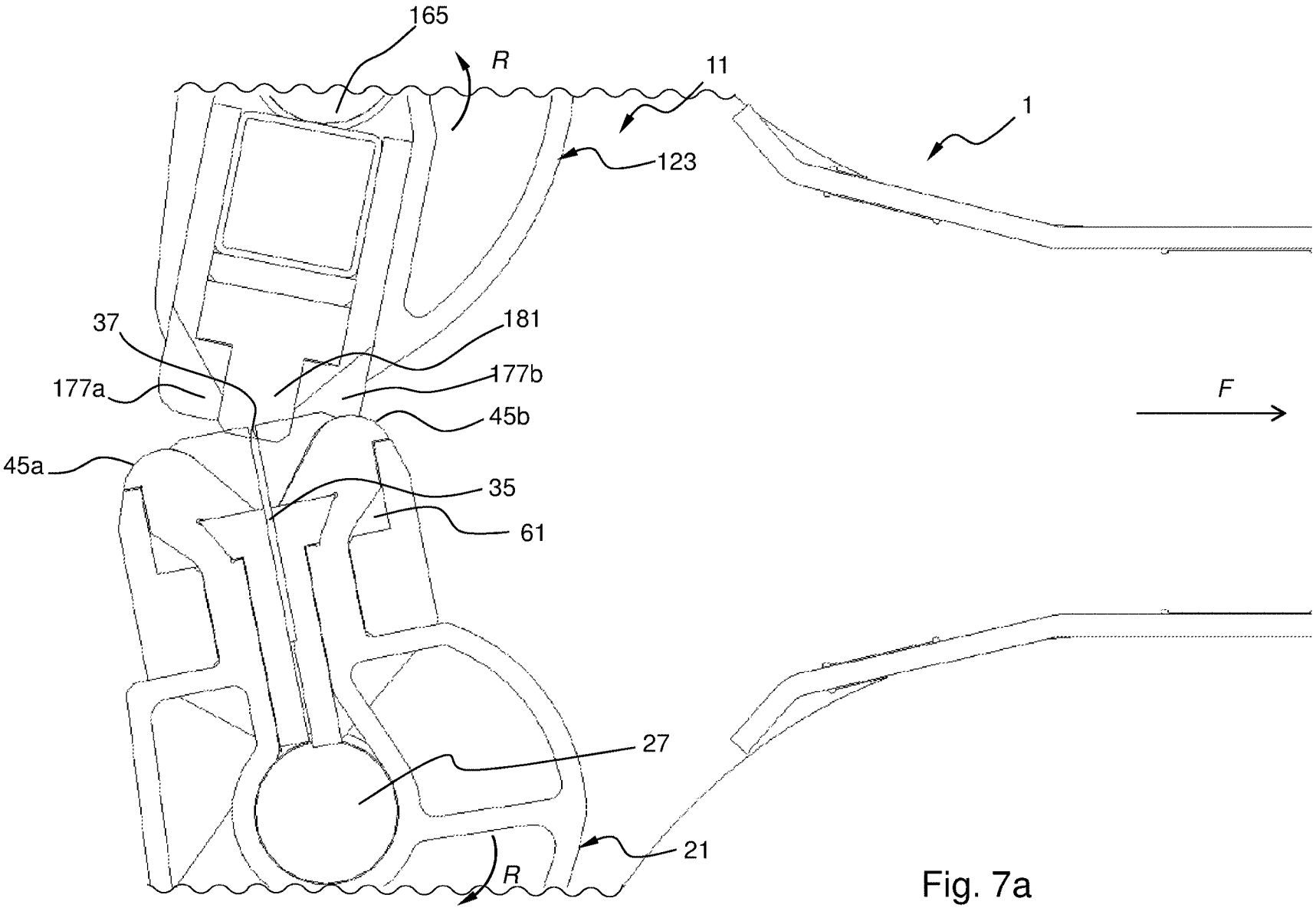
FIGS. 7*a*-7*c* cross-sectional views of the perforation tool according to one embodiment with the receiving tool part according to FIG. 4*b* in three different operational states during and after the perforation process.
Figure 7B:
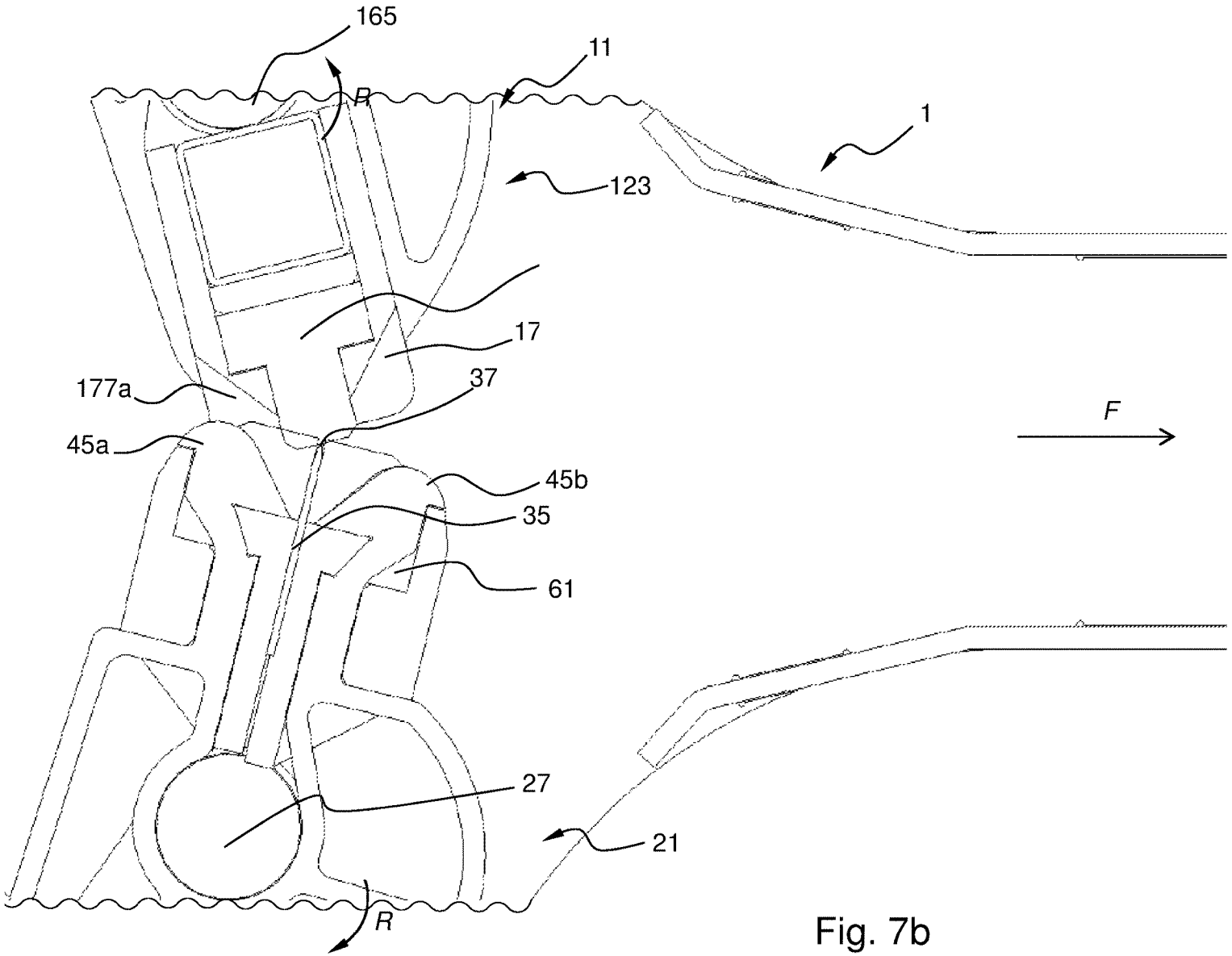
Figure 7C:
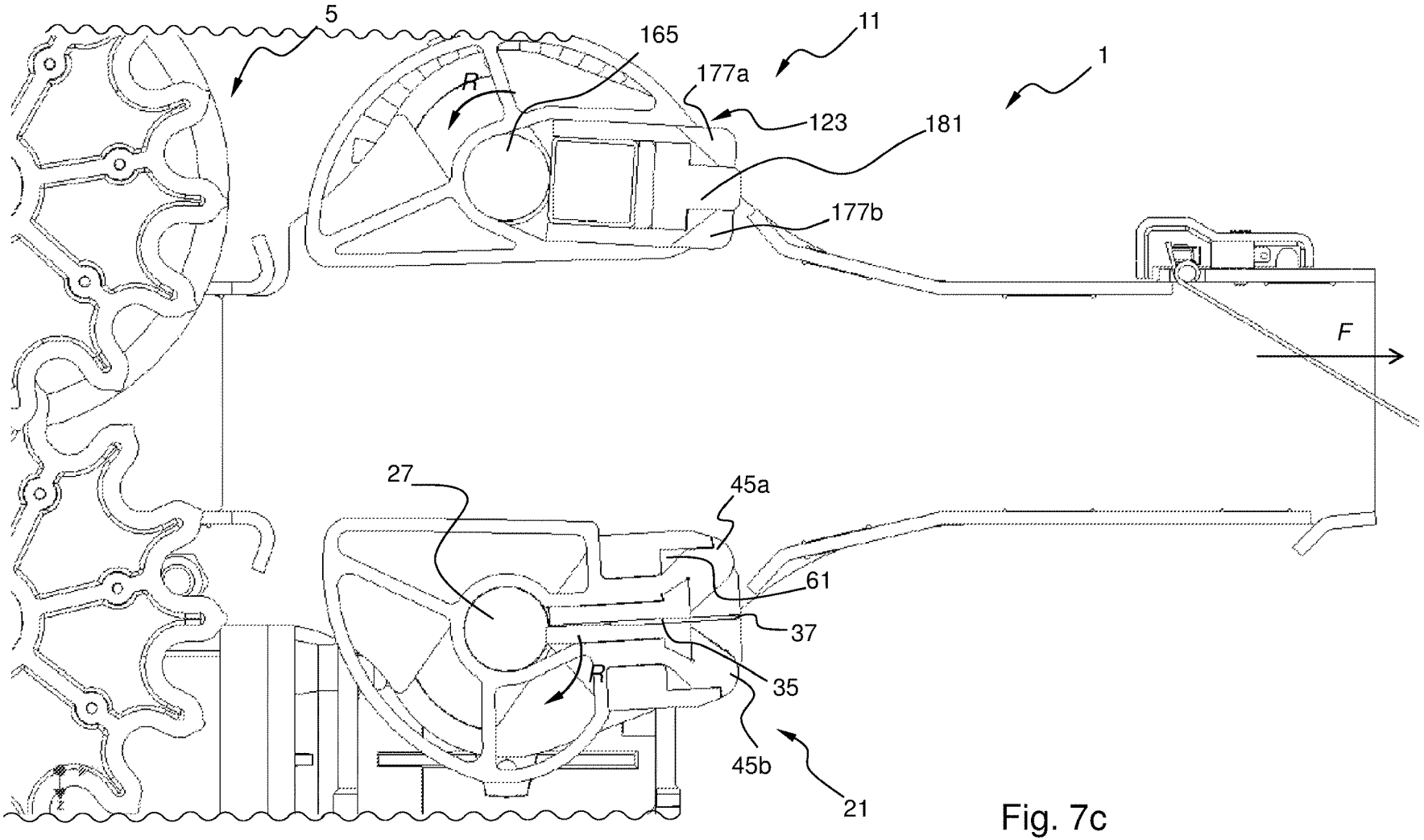

When further disengaging the tools 21, 23 and the elastic restoring forces, all of the paper web material which is potentially adhered to the perforation nose 45*a*, 45*b*, the slit recesses 77*a*, 77*b*, or the blade 37 is wiped away whereby a paper web material jam can be avoided as far as possible. It is clear that the wiping function is performed by the elastic PU-foam body 61 when using an alternative receiving tool 123. As can be seen in FIGS. 7*a* to 7*c*, the perforation tool 11 functions with the alternative receiving tool part 123, which is explained with reference to FIGS. 6*a* to 6*c*.

It is also clear that the wiping function can be realized by other components instead of the elastic PU-foam body 61. The wiping components are movably attached to the nose tool part 21 and independently perform a wiping movement relative to the perforation nose 45*a*, 45*b*, the perforation reception and/or the cutting knife 37. The movable wiping component can for example be arranged in the area of the cavity 55 limited by the gripper pads 51*a*, 51*b* wherein the wiping function can be, for example, similar to a perforation nose and/or a spring-loadable pushing element close to a perforation reception.

The features disclosed in the preceding description, figures and claims can be relevant for the realization of the embodiments individually as well as in any combination of the different embodiments.

LIST OF REFERENCE NUMERALS

1 manufacturing device
5 embossing wheel pair
7 tool station
11 perforation tool
13 housing part
15 disposal opening
21 nose tool part
23, 123 reception tool part
25 basic structure
27 nose shaft
31*a*, *b* clamper plates
33 reception slot
35 cutting knife
37 blade
41 end edge portion
43 hub ring frame
45*a*, *b* perforation noses
47 punching edges
51*a*, *b* gripper pads
55 cavity
57 stripper
59 through holes

61 PU-foam body
63, 163 basic structure
65, 165 perforation reception shaft
67*a, b*, 167*a, b* holding plates
71, 171 seat
73, 173 stamp pad
74, 174 hub ring frame
75, 175 end edge area
77*a, b*, 177*a, b* slit recesses
79, 179 punching edge
83, 183 cutting pad
83*a, b* deformation bars
F direction of travel
R direction of rotation

The invention claimed is:

1. A device for the production by machine of a three-dimensional dunnage material which is to be formed of a single layer or multi-layer paper web, the device comprising:

a pre-shaping station which reshapes the paper web into a three-dimensional dunnage material with at least one hollow crumple space extending in a direction of travel of the paper web;

a cutter following the pre-shaping station in the direction of travel of the paper web, the cutter configured to cut off a paper web portion to a desired length of the three-dimensional dunnage material; and a perforation tool configured for introducing a perforation into the dunnage material, the perforation tool comprising: at least one perforation nose, at least one perforation reception wherein the at least one perforation nose and the at least one perforation reception are associated with each other such that, for perforating, the at least one perforation nose can retract and extend with respect to the at least one perforation reception, and at least one stripper which is associated with at least one of the at least one perforation nose or the at least one perforation reception such that perforated dunnage material is removed from at least one of the at least one perforation nose or the at least one perforation reception as the at least one perforation nose extends with respect to the at least one perforation reception;

wherein the at least one perforation nose and the at least one perforation reception are each attached to a shaft, further wherein a carrier for a stamp pad is arranged at the shaft of the at least one perforation nose, which comprises at least two holding plates radially extending from the shaft of the at least one perforation reception, wherein the at least two holding plates limit a seat for the stamp pad and each of the at least two holding plates comprises an axially extending end edge which comprises a recess for forming the at least one perforation reception, which is configured for a pushing engagement with the at least one perforation nose.

2. The device according to claim 1, wherein the at least one stripper is an additional, movably arranged component with respect to at least one of the at least one perforation reception or the at least one perforation nose.

3. The device according to claim 1, wherein the at least one stripper comprises an elastic mass in which at least one of the at least one perforation nose or the at least one perforation reception is at least partially embedded.

4. The device according to claim 3, wherein in a passive state of the at least one stripper an engagement portion of at least one of the at least one perforation nose or the at least one perforation reception is at least partially surrounded by the elastic mass, wherein the at least one stripper is brought into an active state when retracting, as the engagement portion is exposed from the elastic mass by compression of the elastic mass, wherein when the at least one stripper extends in the event of a transition from the active state into the passive state, the at least one stripper is configured to push material of the paper web from the at least one perforation nose as the compressed mass elastically relaxes.

5. The device according to claim 1, wherein the at least one perforation nose and the at least one perforation reception are each rotationally mounted with respect to each other such that the at least one perforation nose can gearwheel-like turn in and turn off the at least one perforation reception.

6. The device according to claim 1, wherein the shaft of the at least one perforation nose carries a cutter, the cutter including a blade that extends across a direction of travel (F) of the paper web, wherein the at least one perforation nose is arranged in one of leading or trailing in a rotational direction (R) of the shaft with respect to the blade.

7. The device according to claim 6, wherein the blade is embedded into an elastic mass of the at least one stripper and associated with the stamp pad arranged at the shaft of the at least one perforation reception, such that when cutting off the dunnage material, the stamp pad forces back the elastic mass during an elastic compression of the stamp pad to expose the blade such that when extending, the stamp pad releases the compressed elastic mass, such that the elastic mass pushes material of the paper web from the blade due to an elastic restoring force wherein the elastic mass is softer than the stamp pad which is softer than the blade.

8. The device according to claim 7, wherein the cutter comprises two clamper plates attached to a shaft of the at least one perforation nose for limiting a reception slot in which the cutter is fixed and at which the cutter radially protrudes with the blade, wherein a plurality of perforation noses arranged in a row is provided at an axially extending end edge of the clamper plates wherein the plurality of perforation noses extend substantially to a same radial height as the blade, wherein two lateral gripper pads are attached to the clamper plates and limit a reception space, in which the at least one stripper is fixedly received and which is open for an access of at least one of the at least one perforation reception or the stamp pad, wherein the gripper pads comprise radially and axially extending arm portions which prevent a spreading when the at least one stripper elastically deforms, wherein the at least one perforation nose is coupled with both a first clamping plate of the two clamper plates and a first gripper pad of the two lateral gripper pads.

9. The device according to claim 1, wherein the pre-shaping station of the device is realized by an embossing wheel pair.

10. A device for the production by machine of a three-dimensional dunnage material which is to be formed of a single layer or multi-layer paper web, the device comprising:

a pre-shaping station which reshapes the paper web into a three-dimensional dunnage material with at least one hollow crumple space extending in a direction of travel of the paper web;

a cutter following the pre-shaping station in the direction of travel of the paper web, the cutter configured to cut off a paper web portion to a desired length of the three-dimensional dunnage material; and a perforation tool with at least one pad cavity extending in the longitudinal direction, to be formed of a single layer or multi-layer paper web, wherein the perforation tool is configured for introducing a perforation into the dunnage material, the perforation tool comprising:

at least one perforation nose;

at least one perforation reception wherein the at least one perforation nose and the at least one perforation reception are associated with each other such that, for perforating, the at least one perforation nose can retract and extend with respect to the at least one perforation reception; and at least one stripper which is associated with at least one of the at least one perforation nose and the at least one perforation reception such that perforated dunnage material is removed from at least one of the at least one perforation nose and the at least one perforation reception as the at least one perforation nose extends with respect to the at least one perforation reception;

wherein the at least one perforation nose and the at least one perforation reception are each attached to a shaft, further wherein a carrier for a stamp pad is arranged at the shaft of the at least one perforation nose, which comprises at least two holding plates radially extending from the shaft of the at least one perforation reception, wherein the at least two holding plates limit a seat for the stamp pad and each of the at least two holding plates comprises an axially extending end edge which comprises a recess for forming the at least one perforation reception, which is configured for a pushing engagement with the at least one perforation nose.

11. The device according to claim 10, wherein the at least one stripper is an additional, movably arranged component with respect to at least one of the at least one perforation reception or the at least one perforation nose.

12. The device according to claim 10, wherein the at least one stripper comprises an elastic mass in which at least one of the at least one perforation nose or the at least one perforation reception is at least partially embedded.

13. The device according to claim 12, wherein in a passive state of the at least one stripper an engagement portion of at least one of the at least one perforation nose or the at least one perforation reception is at least partially surrounded by the elastic mass, wherein the at least one stripper is brought into an active state when retracting, as the engagement portion is exposed from the elastic mass by compression of the elastic mass, wherein when the at least one stripper extends in the event of a transition from the active state into the passive state, the at least one stripper is configured to push material of the paper web from the at least one perforation nose as the compressed mass elastically relaxes.

14. The device according to claim 10, wherein the at least one perforation nose and the at least one perforation reception are each rotationally mounted with respect to each other such that the at least one perforation nose can gearwheel-like turn in and turn off the at least one perforation reception.

15. The device according to claim 10, wherein the shaft of the at least one perforation nose carries a cutter, the cutter including a blade that extends across a direction of travel (F) of the paper web, wherein the at least one perforation nose is arranged in one of leading or trailing in a rotational direction (R) of the shaft with respect to the blade.

16. The device according to claim 15, wherein the blade is embedded into an elastic mass of the at least one stripper and associated with the stamp pad arranged at the shaft of the at least one perforation reception, such that when cutting off the dunnage material, the stamp pad forces back the elastic mass during an elastic compression of the stamp pad to expose the blade such that when extending, the stamp pad releases the compressed elastic mass, such that the elastic mass pushes material of the paper web from the blade due to an elastic restoring force wherein the elastic mass is softer than the stamp pad which is softer than the blade.

17. The device according to claim 16, wherein the cutter comprises two clamper plates attached to a shaft of the at least one perforation nose for limiting a reception slot in which the cutter is fixed and at which the cutter radially protrudes with the blade, wherein a plurality of perforation noses arranged in a row is provided at an axially extending end edge of the clamper plates wherein the plurality of perforation noses extend substantially to a same radial height as the blade, wherein two lateral gripper pads are attached to the clamper plates and limit a reception space, in which the at least one stripper is fixedly received and which is open for an access of at least one of the at least one perforation reception or the stamp pad, wherein the gripper pads comprise radially and axially extending arm portions which prevent a spreading when the at least one stripper elastically deforms, wherein the at least one perforation nose is coupled with both a first clamping plate of the two clamper plates and a first gripper pad of the two lateral gripper pads.

18. The device according to claim 10, wherein the dunnage material comprises two cushion-like hollow crumple spaces extending in the direction of the web which are connected over an embossed middle area.

* * * * *